United States Patent [19]

Cammack

[11] 4,181,819

[45] Jan. 1, 1980

[54] UNITARY PANEL MULTIPLE FREQUENCY RANGE SPEAKER SYSTEM

[76] Inventor: Kurt B. Cammack, 1024 Southview, Fort Wayne, Ind. 46806

[21] Appl. No.: 924,043

[22] Filed: Jul. 12, 1978

[51] Int. Cl.[2] ..... H04R 5/02

[52] U.S. Cl. ..... 179/1 GA; 179/1 E

[58] Field of Search ..... 179/1 GA, 1 G, 1 E, 179/1 D; 181/144

[56] References Cited

U.S. PATENT DOCUMENTS

| | | | |
|---|---|---|---|
| 3,491,204 | 1/1970 | Sherno | 179/1 GA |
| 3,582,553 | 6/1971 | Bose | 179/1 |
| 3,892,624 | 7/1975 | Shimada | 179/1 G |
| 4,031,318 | 6/1977 | Pitre | 179/1 D |
| 4,054,750 | 10/1977 | Montgomery et al. | 179/1 E |

FOREIGN PATENT DOCUMENTS

| | | | |
|---|---|---|---|
| 803624 | 1/1969 | Canada | 179/1 E |

OTHER PUBLICATIONS

"New Ideas in Stereo Speaker Systems" by Augspurger in *Radio-Electronics,* Mar. 1959, pp. 64–67.

"The Trimensional Stereo Speaker System" by Brociner in *Audio,* Jun. 1959, pp. 21–23, & 74.

*Primary Examiner*—Douglas W. Olms

[57] ABSTRACT

A speaker enclosure is provided with an elongated vertically oriented flat panel having a plurality of vertically spaced speaker openings and a sound port positioned near the upper end of the panel. A pair of stereo related signals are provided to the speaker enclosure, each signal being coupled to a respective crossover network. A first combination of speakers, including a tweeter, mid-range, and woofer is coupled to a first crossover network and provides reproducibility of a first frequency range of audible sounds, and a second crossover network is coupled to a second combination of speakers, including a tweeter and a woofer, to provide a second frequency range of audible sounds which is narrower than said first range. The first and second ranges and crossover frequencies are selected to enhance a first music pattern, such as "jazz," and the second frequency range and crossover frequency network is selected to enhance a second music pattern, such as "rock." The channels may be selected for playing separately for enhancing their respective music patterns or may be selected to play simultaneously to enhance the overlapping frequencies in the frequency ranges.

6 Claims, 4 Drawing Figures

UNITARY PANEL MULTIPLE FREQUENCY RANGE SPEAKER SYSTEM

BACKGROUND OF THE INVENTION

1. Field of the Invention

This invention is in the field of high fidelity audio speaker systems and more particularly to stereo systems having selectable stereo channels.

2. Description of the Prior Art

With the advent of high fidelity stereo sound systems, considerable effort has been expended in utilizing the stereo signals to provide maximum use thereof and listening enjoyment. Such systems are exemplified by devices disclosed in the following U.S. Pat. Nos. 1,965,405; 2,217,279; 3,150,739; 3,255,842; 3,400,217; 3,582,553; 3,491,204; 4,031,318; 4,054,750.

While each of these systems serves its particular function, they do not provide the versatility and capability of separate music pattern enhancement and reinforcement that has been found to add to music listening enjoyment. Generally, channel, crossover network, and speaker combination for each crossover network have been identically provided for separate speaker enclosures to be positioned in spaced relation in a listening area. Multiple stereo channels to separate and distinct crossover networks and corresponding speaker combinations for respective music pattern sound enhancement have not been provided.

SUMMARY OF THE INVENTION

A speaker enclosure has an elongated front panel, vertically oriented, and provided with speaker openings in substantial vertically spaced alignment. The enclosure is adapted to be supported on a floor surface and has at its upper end a sound port and tube in sound communication with the speaker interior. A pair of sound channel signals, stereo related, are provided by a sound amplifier having a control which provides for manual selection of one channel or the other or both channels simultaneously. Each channel signal is carried by a pair of wires, which may be removably secured to posts on a rear speaker panel, with a first set of posts being electrically coupled to a first frequency crossover network mounted interiorly of the speaker. and a second set of posts, for the second channel signal leads, being electrically connected to a second frequency crossover network mounted interiorly of the speaker enclosure.

The first crossover network is electrically coupled to a tweeter having a relatively high frequency reproducible capability, such as 20,000 hz.; a mid-range speaker, and a woofer having a relatively low frequency reproducible capability, such as 22 hz. The crossover frequency between the tweeter and the mid-range speaker is 4,500 hz., and the crossover frequency between the mid-range speaker and the woofer is 500 hz.

The second crossover network is electrically coupled to the tweeter having a more moderate upper frequency reproducible capability, such as 15,000 hz., and electrically coupled to a woofer having a more moderate lower frequency reproducible capability, such as 35 hz. The crossover frequency between the tweeter and woofer in the second speaker combination is 3,000 hz. Each speaker is mounted to the front vertical panel and extends interiorly of the enclosure and the speaker face is substantially co-extensive with its corresponding opening for maximum sound transfer therethrough. The speaker alignment on the front panel is substantially vertical, with the woofer of the first crossover network being mounted lowermost; the woofer of the second crossover network being next above; the mid-range speaker being mounted next above; the tweeter of the first crossover network being mounted next above; and the tweeter of the second crossover network being mounted highest. A sound port is mounted in substantial horizontal alignment with the vertically highest speaker.

The frequency range of reproducible sounds and crossover frequencies of the first channel is selected to enhance a particular music sound pattern, and in this instance enhances a "jazz" sound. The frequency range of reproducible sounds and crossover frequency of the second channel are selected to enhance a second music sound pattern, and in this specific instance, enhances a "rock" sound. Other music sound patterns may be enhanced by proper selection of frequency ranges and crossover frequencies. Further, more than two channels can be utilized in a single speaker enclosure. Thus, the channel selection at the amplifier can be made to enhance a particular music sound pattern. Alternatively, both or all channels may be played with sound enhancement being achieved in the frequency range overlap of the channels, and for providing a stereo effect.

Therefore, it is an object of this invention to provide a sound system having a speaker enclosure for receiving a plurality of sound channel signals, with each signal being coupled through a crossover network to a predetermined speaker combination for a particular music sound pattern.

Another object of this invention is to provide in a system of the previous object a speaker enclosure having a substantially flat panel provided with speaker openings for mounting of all of the speakers in each of the speaker combinations for direct speaker sound broadcasting to a listening area.

A further object is to provide in the system of the previous objects selection means for selecting the channels individually or in combination.

The above-mentioned and other features and objects of this invention and the manner of attaining them will become more apparent and the invention itself will be best understood by reference to the following description of an embodiment of the invention taken in conjunction with the accompanying drawings.

DESCRIPTION OF THE PREFERRED EMBODIMENT

Figure 1:
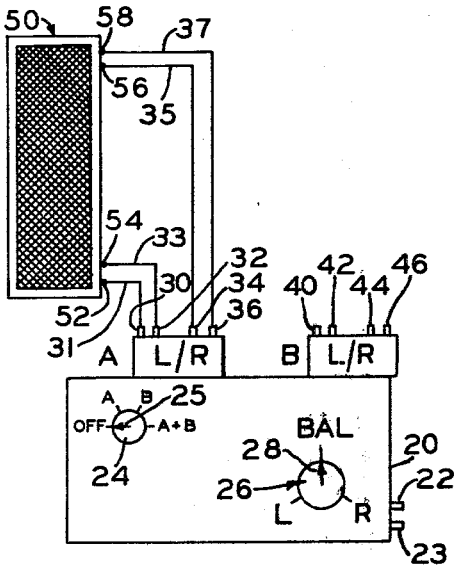
FIG. 1 is a view of an amplifier and speaker enclosure of a sound system shown diagrammatically.

Referring to the drawing, FIG. 1, amplifier 20, which is commercially available from Pioneer, 85 Oxford Drive, Moonachie, N.J., 07074, Model SA-7500, is provided with a set of inputs 22, 23 for each connection to a record player, tape player, or other sound signal source, respectively. Amplifier 20 incorporates an AM-FM stereo tuner, which as is well known, also can provide a sound signal source.

Amplifier 20 has a channel selector 24 with an index 25 manually positionable to "Off," "A," "B," and "A+B." Amplifier 20 also has a balance control 25 having a pointer 28 which is manually positionable from a position "L," or "left," to a position "R," or "right." Further, amplifier 20 has a first output station "A" having a first pair of terminals 30, 32 for a "left" channel output and a second pair of terminals 34, 36 for a "right" channel output. A second station output "B" has a first pair of output terminals 40, 42 for a "left" channel and a second pair of output terminals 44, 46 for a "right" output channel. Since the A station and B station operate in a similar manner, only connections between the A station and a speaker enclosure will be considered in the description below.

When selector 24 is manually adjusted so that index 25 is aligned at the A station, the left channel input 22 will appear at output terminals 30, 32 and the right channel input 23 will appear at terminals 34, 36. If balance control 26 is turned so that indicator 28 is aligned with the "L" limit, then just the amplified left channel signal on terminals 30, 32 will appear, with no signal appearing at terminals 34, 36. If control 26 is manually positioned so that indicator 28 is aligned with the "R" limit, then only the amplified signals of the right channel input 23 will appear at terminals 34, 36, with no signal appearing at 30, 32. When indicator 28 is intermediate the limits "L" and "R," left channel and right channel signals will appear at terminals 30, 32 and terminals 34, 36 respectively, with the relative left channel and right channel volumes determined by the rotational position of control 26 as is well known in the art. As pointer 28 approaches the "L" limit, a correspondingly stronger signal will appear at terminals 30, 32, and as pointer 28 approaches the "R" limit, a relatively stronger signal will appear at terminals 34, 36.

When selector 24 is rotated so that index 25 is opposite "B," then the left channel will appear at terminals 40, 42, and the right channel will appear at terminals 44, 46, and when selector 24 is positioned so that indicator 25 is opposite "A+B", then the left channel will appear at terminals 30, 32 and terminals 40, 42 and the right channel will appear at terminals 34, 36 and terminals 44, 46, as is well understood in the art. In the following description, it is understood that for this embodiment, "jazz" musical sound pattern is coupled to the left channel leads and a "rock" musical pattern is coupled to the right channel leads.

Figure 2:
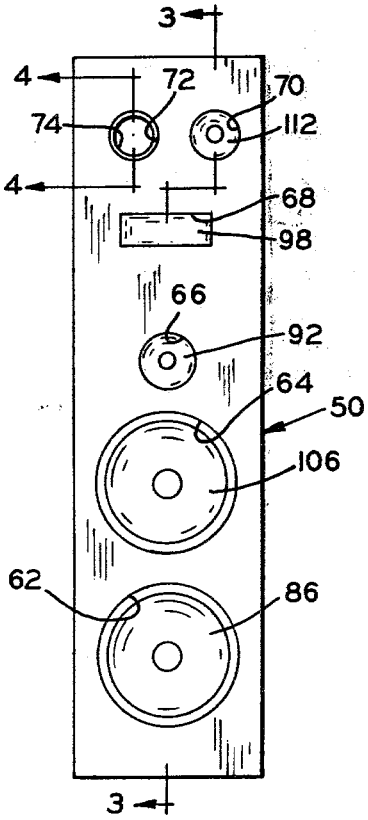
FIG. 2 is a front elevational view of a speaker enclosure having the ornamental grill cover removed.

A speaker enclosure 50 is shown in FIG. 2 with the speaker grille removed. Enclosure 50, as seen in FIG. 3, has terminals 52, 54 electrically coupled to terminals 30, 32 respectively, and terminals 56, 58 electrically coupled to terminals 34, 36 respectively.

Figure 4:
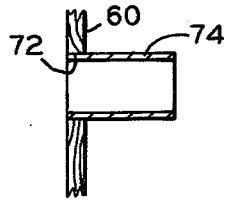
FIG. 4 is a section taken at 4—4 of FIG. 2.
Figure 3:
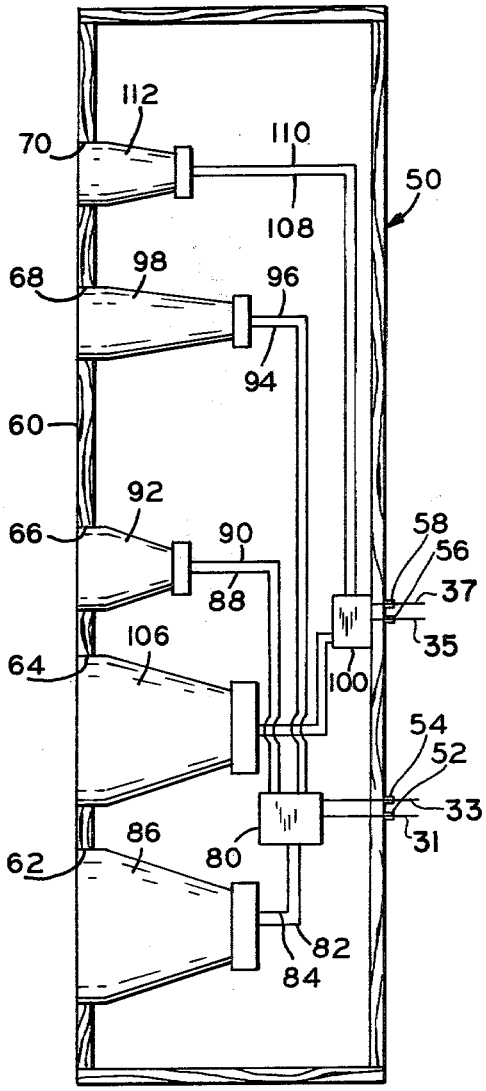
FIG. 3 is a section taken at 3—3 of FIG. 2.

Referring to FIGS. 2 and 3, speaker enclosure 50 and the circuitry therein will now be described. Enclosure 50 has an elongated vertically oriented front panel 60 having openings 62, 64, 66, 68, and 70. Also, panel 60 has a port 72 formed near the upper end thereof in approximate horizontal alignment with opening 70. Referring to FIG. 4, port 72 has a resonance tube 74, 3 inches in diameter and 6 inches in length inserted therein and extending from panel 60 inwardly of enclosure 50.

Referring to FIG. 3, left channel leads 31, 33 are coupled to terminals 52, 54 respectively and right channel leads 35, 37 are coupled to speaker terminals 56, 58 respectively. Terminals 52, 54 are electrically coupled to crossover network 80 which has leads 82, 84 coupled to deep woofer 86 which, in this embodiment has a lower limit of frequency reproducibility of 22 hz.; leads 88, 90 electrically coupled to mid-range speaker 92; and leads 94, 96 electrically coupled to tweeter 98 having an upper limit frequency producibility of 20,000 hz. Network 80 is of standard design and has a first crossover frequency of 500 hz. and a second crossover frequency of 4,500 hz. so that speaker 86 receives frequencies 0 to 500 hz., speaker 92 receives frequencies of 500 to 4,500 hz., and speaker 98 receives frequencies above 4,500 hz. Speaker 86 is of conventional design and mounted to front panel 60 and is substantially coextensive with opening 62, speaker 92 is mounted to panel 60 and is substantially coextensive with opening 66, and tweeter 98 is in this embodiment of the horn type, is mounted to the panel 60 and is substantially coextensive with opening 68.

Terminals 56, 58 are coupled to crossover network 100 which is electrically coupled by leads 102, 104 to woofer 106, which in this embodiment has a lower frequency producibility limit of 35 hz., and is electrically coupled by leads 108, 110 to tweeter 112 which in this embodiment has an upper frequency producibility range of 15,000 hz. Crossover network 100 has a crossover frequency of 3,000 hz. so that electrical signals corresponding to frequencies below 3,000 hz. are coupled to speaker 106 and electrical signals corresponding to frequencies over 3,000 hz. are electrically coupled to speaker 112. Speaker 106 is attached, in conventional manner, to the inner wall of panel 60 and is substantially coextensive with opening 64 and speaker 112 is attached to the inner wall of panel 60 in conventional manner and is substantially coextensive with opening 70.

In operation of the disclosed embodiment, if a jazz musical sound pattern is being reproduced, selector 24 is manually turned until the indicator 25 is opposite "A" and balance adjustment 26 is turned until indicator 28 is opposite "L." With this adjustment, a signal will be present on leads 31, 33 to crossover network 80 with speakers 86, 92, and 98 being utilized. This will result in frequency production between 22 hz. and 20,000 hz. with crossover frequencies at 500 hz. and 4,500 hz. This has been found to enhance jazz sounds, and as mentioned, can be modified for other musical sound patterns. When a rock musical sound pattern is desired, selector knob 24 is turned until indicator 25 is opposite "A" and balance adjustment 26 is turned until indicator 28 is opposite "R." With this adjustment, signals will be applied to leads 35, 37 and through terminals 56, 58 to crossover network 100 wherein speakers 106 and 112 will be utilized. A frequency reproducible range of 35 hz. to 15,000 hz. with the crossover at 3,000 hz. provides enhancement of the rock musical sound pattern. If for any given musical composition, a mix of the two sound patterns is desired for sound reproducible redundancy of those frequencies wherein the aforementioned frequency ranges overlap, balance adjustment knob 26 may be positioned intermediately of the "L" and "R" limits wherein both channels, the channel on lines 31, 33 and the channel on lines 35, 37, will be utilized and reproduced. The closer indicator 28 is to the "R" limit, the higher the volume on the channel carried by lines 35, 37 will be relative to the channel carried by lines 31, 33. As indicator 28 is moved towards the limit "L," the volume in the channel carried by lines 35, 37 will decrease and the volume carried by channels 31, 33 will increase. The resultant sound has a fullness not heretofore available and when a stereo musical sound pattern having the left channel carried by lines 31, 33 and the right channel carried by lines 35, 37 is reproduced, a stereo effect is obtainable from the speakers in enclosure 50.

By having a sound port 72 at the upper end of the elongated enclosure 50, which in a preferred embodiment is approximately 4 feet high, sound emission from port 72 is closer to listener ear level for further enhancement of sound appreciation.

A second speaker enclosure 50 may be connected in comparable manner to the terminals of station B for a preferred sound distribution pattern.

Further, leads 35, 37 may be coupled to terminals 40, 42 of station B. With this connection, the sound pattern on leads 31, 33 may be selected exclusive of that pattern on leads 35, 37 by moving selector 24 so that index 25 is aligned with "A" and the sound pattern on leads 35, 37 may be selected exclusive of that pattern on leads 31, 33 by moving selector 24 so that index 25 is aligned with "B."

While there have been described above the principles of this invention in connection with specific apparatus, it is to be clearly understood that this description is made only by way of example and not as a limitation to the scope of the invention.

What is claimed is:

1. A speaker system comprising:

a speaker enclosure having a substantially flat panel;

said panel having a plurality of speaker sound transmission areas, each area for receiving in sound transmission relation a sound emitting speaker to direct sound emissions from said areas in a direction substantially transverse to said panel;

means for producing multiple channels each carrying respective electrical signals for transducing to sound waves;

a plurality of speakers being mounted to said panel in sound transmitting relation to respective of said speaker areas;

a plurality of crossover networks;

a first crossover network being coupled between a first channel and a first combination of speakers for transducing electrical signals to sound waves;

a second crossover network being coupled between a second channel and a second combination of speakers for transducing electrical signals to sound waves, said second combination of speakers being different than said first combination;

said first combination of speakers is responsive to a first range of frequencies and said second combination of speakers is responsive to a second range of frequencies different than said first range of frequencies, said first and second ranges of frequencies selectable to enhance respective predetermined sound patterns.

2. The apparatus of claim 1 wherein said panel is elongated and substantially vertically oriented;

a sound port being positioned adjacent the upper end of said panel for sound transfer from the speaker enclosure.

3. The apparatus of claim 1 including selecting means for selecting said first channel only, said second channel only, and both said channels, whereby when said first channel is selected said first sound pattern will be enhanced, when said second channel is selected, said second sound pattern will be enhanced, and when both channels are selected, the overlapping frequencies in said first and second ranges will be enhanced.

4. A speaker system comprising:

a speaker enclosure having a substantially flat panel;

said panel having a plurality of speaker sound transmission areas, each area for receiving in sound transmission relation a sound emitting speaker to direct sound emissions from said areas in a direction substantially transverse to said panel;

means for producing multiple channels each carrying respective electrical signals for transducing to sound waves;

a plurality of speakers being mounted to said panel in sound transmitting relation to respective of said speaker areas;

a plurality of crossover networks;

a first crossover network being coupled between a first channel and a first combination of speakers for transducing electrical signals to sound waves;

a second crossover network being coupled between a sound channel and a second combination of speakers for transducing electrical signals to sound waves, said second combination of speakers being different than said first combination;

said first combination of speakers includes a first tweeter having a frequency producibility range to a first upper limit and a first woofer having a first lower limit and said first crossover network coupled to said tweeter and woofer having a first crossover frequency between said tweeter and woofer;

said second combination of speakers includes a second tweeter having a frequency producibility range having a second upper limit, a mid-range speaker, and a second woofer having a frequency reproducibility range having a second lower limit, said second crossover network being coupled to said second tweeter, mid-range speaker, and second woofer and having a second crossover frequency between said woofer and mid-range speaker and a third crossover frequency between said mid-range speaker and tweeter.

5. The apparatus of claim 4 wherein said panel is elongated and substantially vertically oriented;

said areas being substantially vertically spaced one from the other;

said second woofer being in sound transmission relation with the lowermost first area;

said first woofer being in sound transmission relation with a second area next above the first area;

said mid-range speaker being in sound transmission relation with a third area next above said second area;

said second tweeter being in sound transmission relation with a fourth area next above said third area; and said first tweeter being in sound transmission relation to a fifth area next above said fourth area.

6. The apparatus of claim 4 wherein said first upper limit is approximately 15,000 hz.; said first lower limit being approximately 35 hz.; said first crossover frequency being approximately 3,000 hz.;

said second upper limit being approximately 20,000 hz.; said second lower limit being approximately 22 hz.; said second crossover frequency being approximately 500 hz.; and said third crossover frequency being approximately 4,500 hz.

* * * * *

UNITED STATES PATENT AND TRADEMARK OFFICE

CERTIFICATE OF CORRECTION

PATENT NO. : 4,181,819

DATED : January 1, 1980

INVENTOR(S) : Kurt B. Cammack

It is certified that error appears in the above-identified patent and that said Letters Patent are hereby corrected as shown below:

Column 6, line 21 for "sound" read --second--;
Column 6, line 29 before "tweeter" insert --first--;
Column 6, line 29 before "woofer" insert --first--;
Column 6, line 30 before "tweeter" insert --first--;
Column 6, line 31 before "woofer" insert --first--;
Column 6, line 40 before "woofer" insert --second--;
Column 6, line 42 before "tweeter" insert --second--.

Signed and Sealed this

*Fifteenth* Day of *April 1980*

[SEAL]

*Attest:*

SIDNEY A. DIAMOND

*Attesting Officer*

*Commissioner of Patents and Trademarks*